US008109496B2

(12) United States Patent
Taguchi et al.

(10) Patent No.: US 8,109,496 B2
(45) Date of Patent: Feb. 7, 2012

(54) SHEET PROCESSING APPARATUS AND METHODS FOR ALLOWING SHEET REMOVAL AFTER PROCESS CANCELLATION

(75) Inventors: Hiroyuki Taguchi, Shizuoka-Ken (JP); Ken Iguchi, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/952,651

(22) Filed: Nov. 23, 2010

(65) Prior Publication Data

US 2011/0068529 A1 Mar. 24, 2011

Related U.S. Application Data

(62) Division of application No. 12/343,076, filed on Dec. 23, 2008, now Pat. No. 7,862,024.

(60) Provisional application No. 61/016,930, filed on Dec. 27, 2007, provisional application No. 61/036,447, filed on Mar. 13, 2008.

(51) Int. Cl.
*B65H 37/04* (2006.01)

(52) U.S. Cl. ..... 270/58.09; 270/58.08; 270/58.11

(58) Field of Classification Search ..... 270/58.08, 270/58.09, 58.11, 58.12, 58.13
See application file for complete search history.

(56) References Cited

U.S. PATENT DOCUMENTS

| | | | | |
|---|---|---|---|---|
| 5,342,037 | A | 8/1994 | Martin | |
| 5,667,215 | A | 9/1997 | Yoshino | |
| 5,944,645 | A | 8/1999 | Kobayashi | |
| 6,921,069 | B2 | 7/2005 | Suzuki et al. | |
| 6,957,810 | B2 * | 10/2005 | Yamada et al. | 270/58.08 |
| 6,988,727 | B2 | 1/2006 | Yano | |
| 7,036,811 | B2 | 5/2006 | Howe | |
| 7,055,815 | B2 * | 6/2006 | Sato et al. | 270/58.11 |
| 7,328,892 | B2 | 2/2008 | Asami et al. | |
| 7,431,291 | B2 * | 10/2008 | Sato et al. | 271/265.01 |
| 7,681,873 | B2 * | 3/2010 | Tsutsui et al. | 270/58.08 |
| 7,802,782 | B2 * | 9/2010 | Moriyama et al. | 270/58.12 |
| 7,874,558 | B2 * | 1/2011 | Ogata et al. | 271/221 |
| 2002/0060414 | A1 * | 5/2002 | Yamada et al. | 271/221 |
| 2004/0070133 | A1 | 4/2004 | Yamada et al. | |
| 2004/0084827 | A1 | 5/2004 | Takamura | |
| 2004/0183246 | A1 | 9/2004 | Jung et al. | |
| 2008/0145120 | A1 * | 6/2008 | Okada | 399/361 |

FOREIGN PATENT DOCUMENTS

| | | |
|---|---|---|
| JP | 07-237785 | 9/1995 |
| JP | 11-116134 | 4/1999 |
| JP | 2000-177919 | 6/2000 |
| JP | 2001-199628 | 7/2001 |
| JP | 2002-362825 | 12/2002 |
| JP | 2003-182928 | 7/2003 |
| JP | 2005-001863 | 1/2005 |

* cited by examiner

*Primary Examiner* — Patrick Mackey
(74) *Attorney, Agent, or Firm* — Patterson & Sheridan, LLP

(57) ABSTRACT

A sheet processing apparatus is disclosed. The sheet processing apparatus has a stacking unit configured to stack a sheet discharged from an image forming unit, the stacking unit including a stacker being configured to support a lower end of the sheet and a supporter being configured to support an under side of the sheet; a driver configured to drive the stacker along the supporter; and an opening configured for allowing removal of the sheet on the stacker to an outside; and a controller configured to control the stacker so that the stacker is driven to the opening along the supporter if a process is cancelled and if the sheet on the stacker needs to be removed.

20 Claims, 13 Drawing Sheets

SHEET PROCESSING APPARATUS AND METHODS FOR ALLOWING SHEET REMOVAL AFTER PROCESS CANCELLATION

CROSS-REFERENCE TO RELATED APPLICATIONS

This application is a divisional of U.S. patent Ser. No. 12/343,076, filed Dec. 23, 2008, which is based upon and claims the benefit of priority from; U.S. provisional application 61/016,930, filed on Dec. 27, 2007; and U.S. provisional application 61/036,447, filed on Mar. 13, 2008, the entire contents of each of which are incorporated herein by reference.

TECHNICAL FIELD

The present invention relates to a sheet finisher, an image forming apparatus using the sheet finisher, and a sheet finishing method, and particularly to a sheet finisher, an image forming apparatus, and a sheet finishing method folding a sheet.

BACKGROUND

There was a sheet finisher which perform a sheet finishing such as punching or saddle-stitching of sheets printed by an image forming system such as a copier, a printer, and a multi-functional peripheral (MFP).

Functions of the sheet finisher become diverse. There is suggested a sheet finisher which has a function of folding a part of sheets or a function of saddle-stitching which saddles an intermediate part of the sheets after the intermediate part of the sheets is stapled in addition to the functions of punching and saddle-stitching (see JP-A-2004-59304, JP-A-2003-182928, etc.).

The sheet finisher that has the saddle-stitching functions is also capable of producing (binding) plural printed sheets into a book.

In the known intermediate saddle-stitching functions suggested in the past, the intermediate part of sheets is stapled and the stapled part of the sheets are saddled by a pair of rollers called a pair of saddle rollers. In this case, a plate-shaped member called a folding blade is put on the stapled portion of a bundle of sheets and inserts the bundle of sheets into a nip of the pair of saddle rollers to form the folding line on the bundle of sheets.

There is disclosed a technique for discharging the sheets by force, if it is detected that a series of discharge operations are canceled due to jam occurrence or the like during stacking sheets (for example, see JP-A-2000-177919, etc.).

However, if it is difficult to discharge sheets forcibly in jam occurrence in the vicinity of a sheet discharging mechanism of the sheet finisher, the sheets stopped in an erect tray have to be removed. In this case, it is difficult for a user to remove the sheets since an opening is narrow in a state where jogger fences of the erect tray guide the sheets.

If the sheets are relatively small in size, it is more difficult for the user to reach and remove the sheet. That is because the sheet finisher stacks the sheets on the erect tray at a location which is away from the opening.

In the past, there was a method of detecting the upper portion of the books which a saddle tray stacks by using a sensor in order to detect a fullness state of the saddle tray and the like subjected to folding. Moreover, there was suggested a method of calculating and estimating the fullness state using the number of sheets and the size and weight of the sheets discharged to the saddle tray. However, it is determined that the saddle tray is full even in a case of the half of actual stacking limit, since it is necessary to operate the sheet finisher in consideration of a large margin in the actual fullness state.

If a job for detecting that the saddle tray is full is canceled like the above method and stacking the books up to the mechanical limit of the saddle tray is intended, resistance of the stacked books causes a torque limiter or the like to operate and thus it is difficult to push a new book, thereby resulting in a discharge error.

SUMMARY

The invention is devised in view of the above-mentioned circumstances and an object of the invention is to provide a sheet finisher, an image forming apparatus, and a sheet finishing method which performs saddle-stitching and is capable of removing sheets in an erect tray.

Moreover, the invention is devised in view of the above-mentioned circumstances and another object of the invention is to provide the sheet finisher, the image forming apparatus, and the sheet finishing method capable of stacking books at a location of mechanical limit and detecting that a saddle tray is full without mechanical discharge jam.

According to an aspect of the invention, in order to attain the objects, a sheet finisher includes: a folding mechanism configured to form a folding line by folding a sheet which an image forming unit discharges; a discharging mechanism configured to discharge the sheet including the folding line which the folding mechanism forms; a stacking mechanism configured to stack the sheet which the discharging mechanism discharges; and a slip amount calculator configured to output a fullness state of the stacking mechanism to the image forming unit, if a slip amount of the discharging mechanism exceeds a threshold.

According to another aspect of the invention, an image forming apparatus includes: an image forming unit configured to print an image on a sheet; a folding mechanism configured to form a folding line by folding a sheet which the image forming unit discharges; a discharging mechanism configured to discharge the sheet including the folding line which the folding mechanism forms; a stacking mechanism configured to stack the sheet which the discharging mechanism discharges; and a slip amount calculator configured to output a fullness state of the stacking mechanism to the image forming unit, if a slip amount of the discharging mechanism exceeds a threshold.

According to still another aspect of the invention, a sheet finishing method comprising acts of: forming a folding line by folding a sheet which an image forming unit discharges; discharging the sheet to a stacking mechanism by a discharging mechanism; and outputting a fullness state of the stacking mechanism to the image forming unit, if a slip amount of the discharging mechanism exceeds a threshold.

DESCRIPTION OF THE DRAWINGS

In accompanying drawings.

DETAILED DESCRIPTION

A sheet finisher, an image forming apparatus, and a sheet finishing method will be described with reference to the accompanying drawings according to an embodiment.

(1) Structure of Image Forming Apparatus

Figure 1:
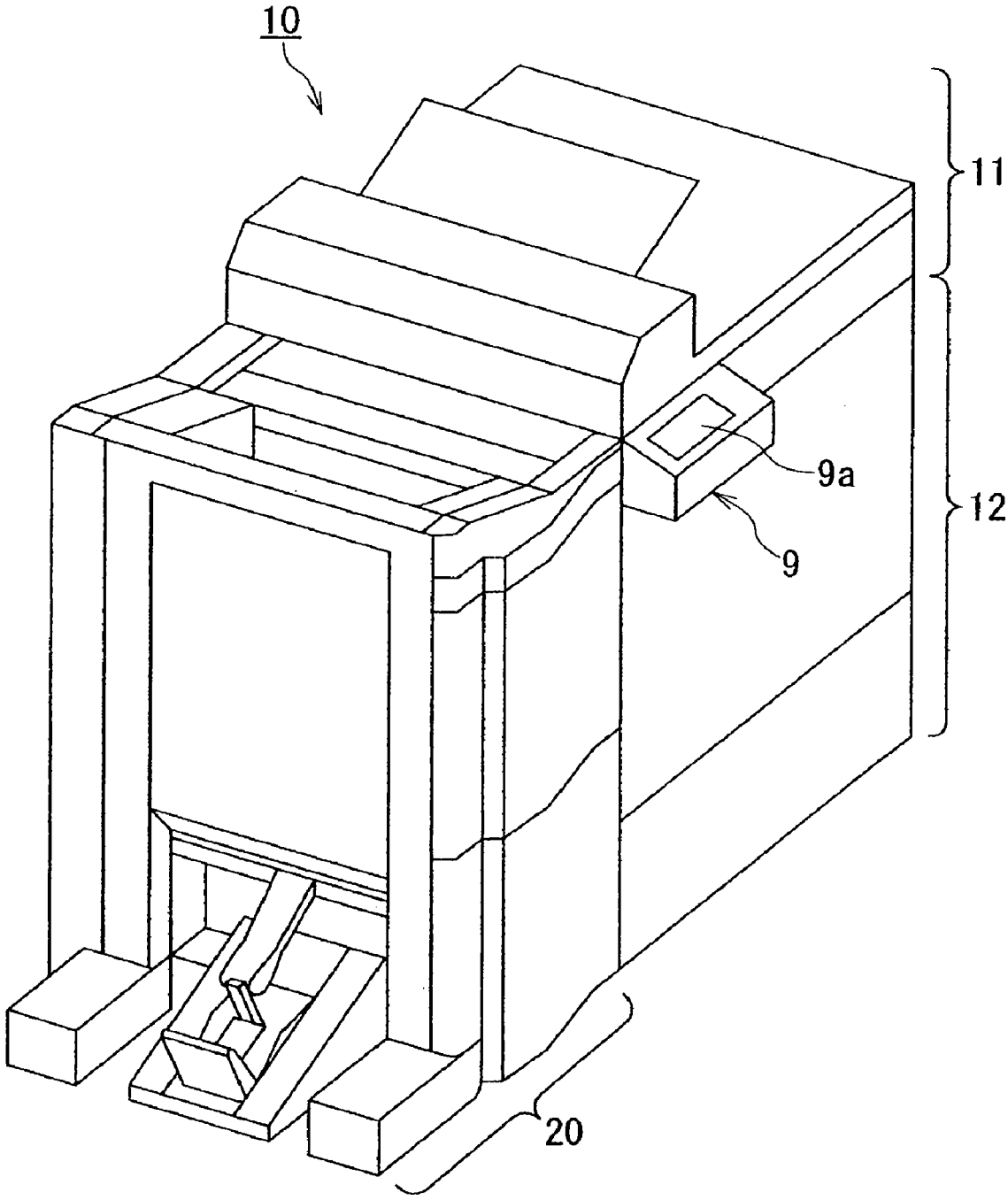
FIG. 1 is a perspective view illustrating a major configuration example of the image forming apparatus according to the embodiment.

FIG. 1 is a perspective view illustrating a basic configuration example of the image forming apparatus according to the embodiment.

FIG. 1 shows an image forming apparatus 10 according to this embodiment. The image forming apparatus 10 includes a reading unit 11 reading a document, an image forming system 12 printing image data of the read document on a sheet using an electrographic method, and a sheet finisher 20 performing finishing such as sorting, punching, folding, and saddle-stitching on printed sheets. The image forming system 12 includes a display panel 9*a* and an operation unit 9 used for a user to carry out various operations.

Figure 2:
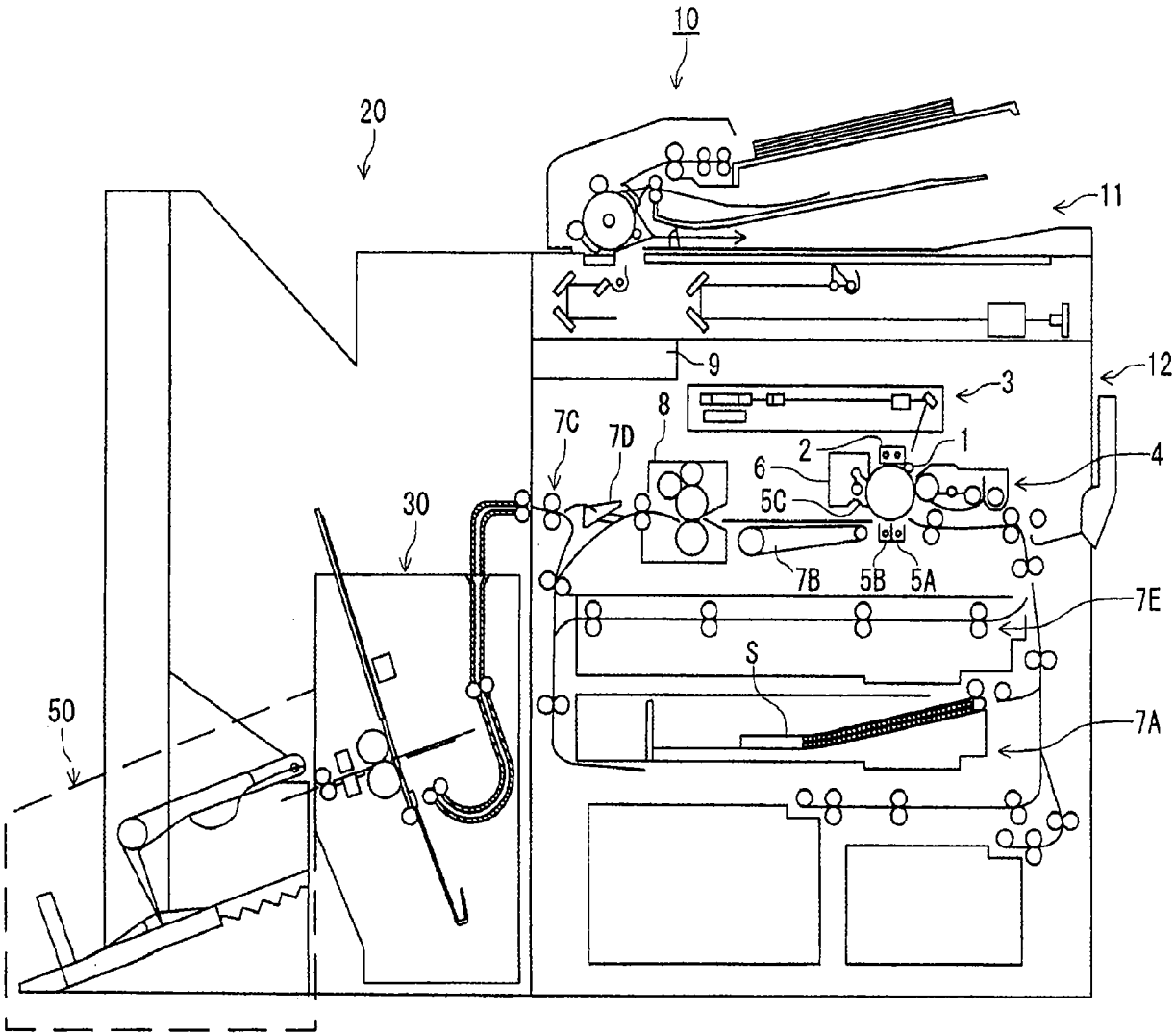
FIG. 2 is a sectional view illustrating a detailed configuration example of the image forming apparatus.

FIG. 2 is a sectional view illustrating a detailed configuration example of the image forming apparatus 10.

The image forming system 12 of the image forming apparatus 10 includes a photoconductive drum 1 in the vicinity of the middle portion. The image forming system 12 has a charging unit 2, an exposure unit 3, a development unit 4, a decal unit 5A, an electric charge removing unit 5B, a separation claw 5C, and a cleaning unit 6 in the circumference of the photoconductive drum 1. The image forming system 12 has a fixing unit 8 on a downstream side of the electric charge removing unit 5B.

The charging unit 2 of the image forming system 12 charges uniformly on the surface of the photoconductive drum 1. The image forming system 12 converts a document which the reading unit 11 reads into image data, and inputs the image data to the exposure unit 3. The exposure unit 3 emits a laser beam onto the photoconductive drum 1 according to a level of the image data, and forms an electrostatic latent image on the photoconductive drum 1. The photoconductive drum 1 develops the electrostatic latent image with toner supplied from the development unit 4, and forms a toner image.

The image forming system 12 transports each of sheets which a sheet receiving unit 7 has to a decal position (a gap between the photoconductive drum 1 and the decal unit 5A) through several transport rollers. At the decal position, the decal unit 5A decals the toner image from the photoconductive drum 1 onto the sheet. The electric charge removing unit 5B removes an electric charge on the surface of the sheet. The separation claw 5C separates the sheet from the photoconductive drum 1. An intermediate transport unit 7B transports the sheet to the fixing unit 8. The fixing unit 8 fixes the toner image on the sheet by heating and pressurizing the sheet. A discharging unit 7C discharges the sheet fixed the toner image to the sheet finisher 20.

The photoconductive drum 1 removes developer remaining on the surface on a downstream side of the separation claw 5C by a cleaning unit 6

If the image forming system 12 perform printing on both sides of a sheet, the image forming system 12 branches the sheet on which the toner image is fixed from a normal discharge passage by a transport passage switching plate 7D, and performs switchback to reverse the both sides of the sheet on a reverse transport unit 7E. The image forming system 12 performs the same printing as the printing on one side of the sheet on the other side of the reversed sheet, and discharges the sheet from the discharging unit 7C to the sheet finisher 20.

The sheet finisher 20 includes a saddle stitcher 30 and a saddle tray 50 in addition to a sorter sorting sheets. A controller (CPU: central processing unit) based on an instruction input from a user controls operations of constituent elements in the sheet finisher 20.

The saddle stitcher 30 staples the intermediate part of the plural sheets subjected to the printing, which the image forming system 12 discharges, and saddles the sheets. The saddle stitcher 30 outputs a book which the saddle stitcher 30 produces by saddle-stitching to the saddle tray 50. The saddle tray 50 receives the book.

Figure 3:
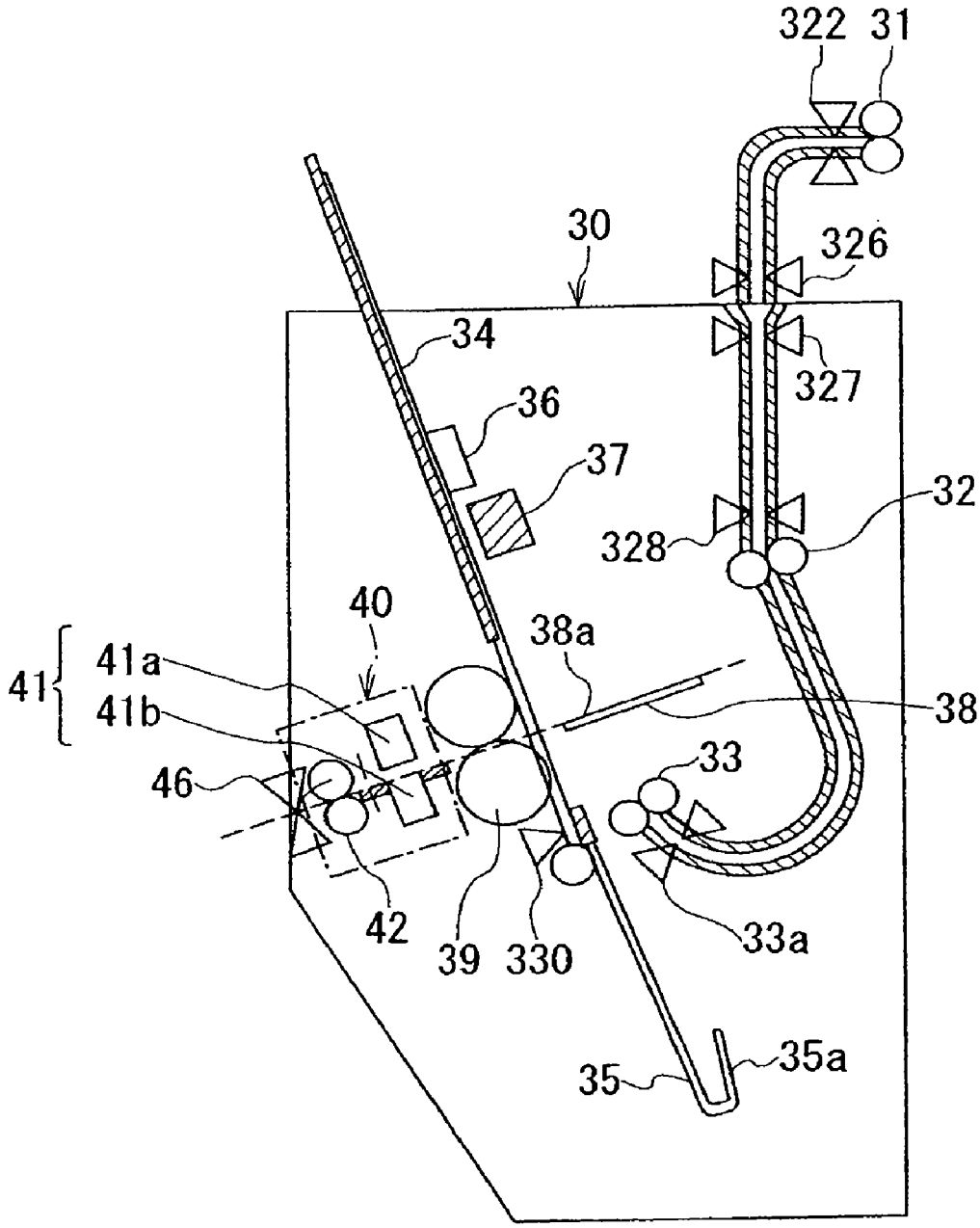
FIG. 3 is a sectional view illustrating a detailed configuration example of a saddle stitcher.

FIG. 3 is a sectional view a detailed configuration example of the saddle stitcher 30.

The saddle stitcher 30 allows a pair of entrance rollers 31 to receive the sheet which the discharging unit 7C of the image forming system 12 discharges, and transports the sheet to a pair of intermediate rollers 32. The pair of intermediate rollers 32 transports a pair of exit rollers 33. The pair of exit rollers 33 transports the sheet to an erect tray 34 having a placing slope surface. Then, a front end of each sheet faces to an upper portion of the slope of the erect tray 34.

The saddle stitcher 30 has a stacker 35 below the erect tray 34. A stacker claw 35*a* formed in the lower portion of the stacker 35 receives the lower end of the sheet reversed and dropped from the upper slope portion of the erect tray 34 and aligns the rear end of the sheet. A jogger fence 36 aligns the sheets in a width direction (a direction perpendicular to a sheet transport direction) of the sheet.

The saddle stitcher 30 has a stapler 37 in the middle portion of the erect tray 34. If the stapler 37 staples a bundle of sheets, the erect tray 34 adjusts a location of the stacker 35 so that the location (the intermediate portion in the sheet transport direction) where the bundle of sheets is subjected to the stapling is opposed to the stapler 37.

When the stapler 37 stitches the bundle of sheets, the stacker 35 descends until a portion (which is the intermediate portion in the sheet transport direction and the location where a staple is inserted) where a folding line is to be formed in the bundle of sheets reaches the front of a folding blade 38.

When the portion where the folding line is to be formed reaches the front of the folding blade 38, a front end 38*a* of the folding blade 38 inserts a surface which becomes an inner surface after the folding blade 38 saddles the bundle of sheets.

The saddle stitcher 30 has a pair of folding rollers 39 at the end in a movement direction of the folding blade 38. A nip of the pair of folding rollers 39 winds the bundle of sheets which the folding blade 38 inserts, and forms the folding line on the intermediate portion of the bundle of sheets. The folding blade 38 and the pair of folding rollers 39 form folding unit.

The pair of folding rollers 39 forms the folding line on the bundle of sheets, and transports the bundle of sheets to a discharging mechanism 40 disposed at a further downstream side of the pair of folding rollers 39. The discharging mechanism 40 temporarily stops a transport of the bundle of sheets which the pair of folding rollers 39 transports.

The discharging mechanism 40 includes a pair of saddle reinforcing rollers 41 (an upper saddle reinforcing roller (second roller) 41*a* and a lower saddle reinforcing roller (first roller) 41*b*) as a saddle reinforcing unit and a pair of transport rollers 42. The saddle reinforcing rollers 41 moves while pressurizing the folding line in a direction (which is a direction along the folding line) perpendicular to a transport direction of the bundle of sheets to enhance the folding line.

The pair of saddle reinforcing rollers 41 enhances the folding line of the bundle of sheets, and outputs the bundle of sheets to the saddle tray 50. The saddle tray 50 places the bundle of sheets as a book.

A feeding sensor 322, an entrance sensor 326 of a connection part, a first transport path sensor 327, and a second transport path sensor 328 detect the sheet between the pair of entrance rollers 31 and the pair of intermediate rollers 32. A transport sensor 33*a* detects the sheet between the pair of intermediate rollers 32 and the pair of exit rollers 33. A stacker sensor 330 detects the sheet on the stacker 35. A discharging sensor 46 detects the sheet which the pair of transport rollers 42 discharges. The whole of the feeding sensor 322, the entrance sensor 326, the first transport path sensor 327, the second transport path sensor 328, the transport sensor 33*a*, stacker sensor 330, and the discharging sensor 46 is called "transport sensor 146" as follows.

An entrance motor drives the pair of entrance rollers 31. A stacker motor drives the stacker 35 in the top and the bottom. A saddle transporting motor drives the pair of intermediate rollers 32 and the pair of exit rollers 33, and transports the sheet from a feeding intake to the stacker 35. A discharging motor 45 drives the pair of folding rollers 39 and the pair of transport rollers 42. The whole of the entrance motor, the stacker motor, the saddle transporting motor, and the discharging motor 45 is called "transport motors 145" as follows.

The functions and operations of the stacker 35, the jogger fence 36, and the discharging mechanism 40 by the control of the sheet finisher 20 will be described in detail in sequence.

(2) Configuration, Function, and Operation of Stacker 35 and Jogger Fence 36

Figure 4:
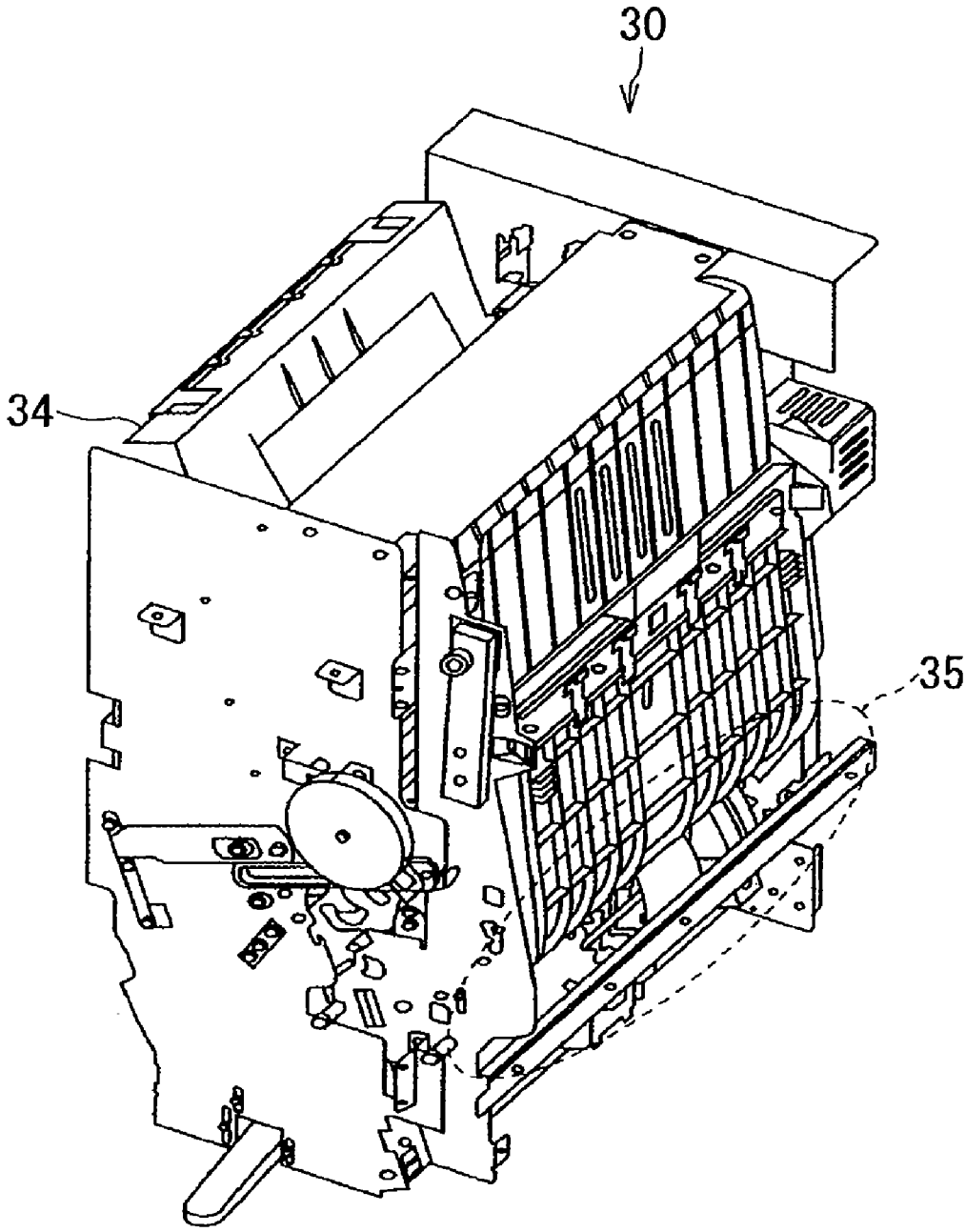
FIG. 4 is a perspective view illustrating a whole configuration example of the saddle stitcher.

FIG. 4 is a perspective view illustrating a whole configuration example of the saddle stitcher 30.

The saddle stitcher 30 includes the erect tray 34 and the stacker 35. The stacker 35 is disposed below the erect tray 34.

Figure 5:
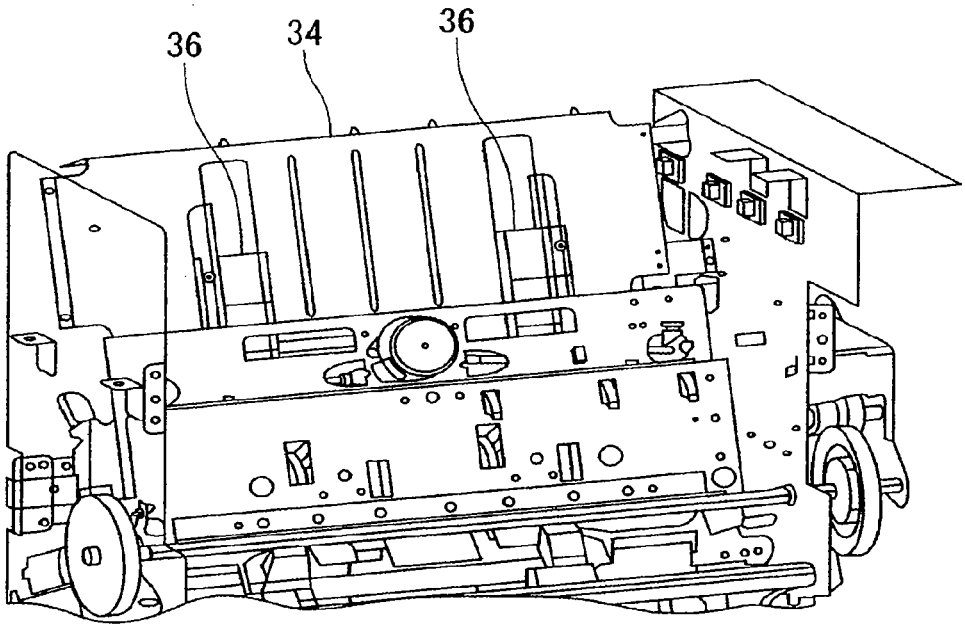
FIG. 5 is a perspective view illustrating a jogger fence of the saddle stitcher.
Figure 6:
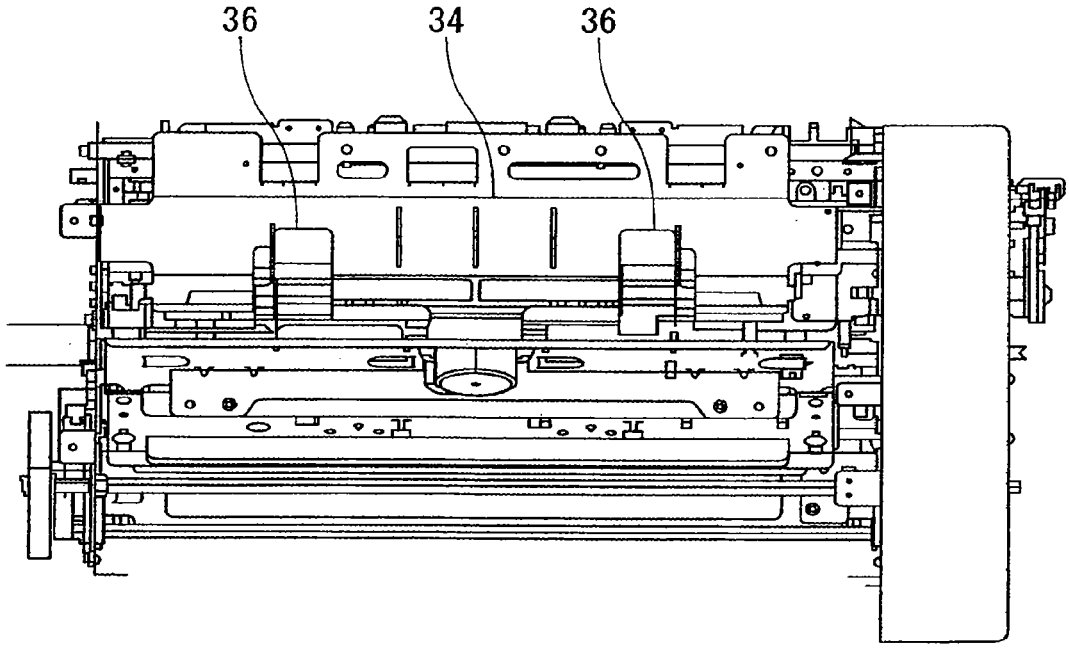
FIG. 6 is an upper external view illustrating the jogger fence of the saddle stitcher.

FIG. 5 is a perspective view illustrating the jogger fence 36 included in the saddle stitcher 30. FIG. 6 is an upper external view illustrating the jogger fence 36 included in the saddle stitcher 30. The erect tray 34 of the saddle stitcher 30 includes the jogger fence 36 aligning the sheets in the width direction of the sheets.

Figure 7:
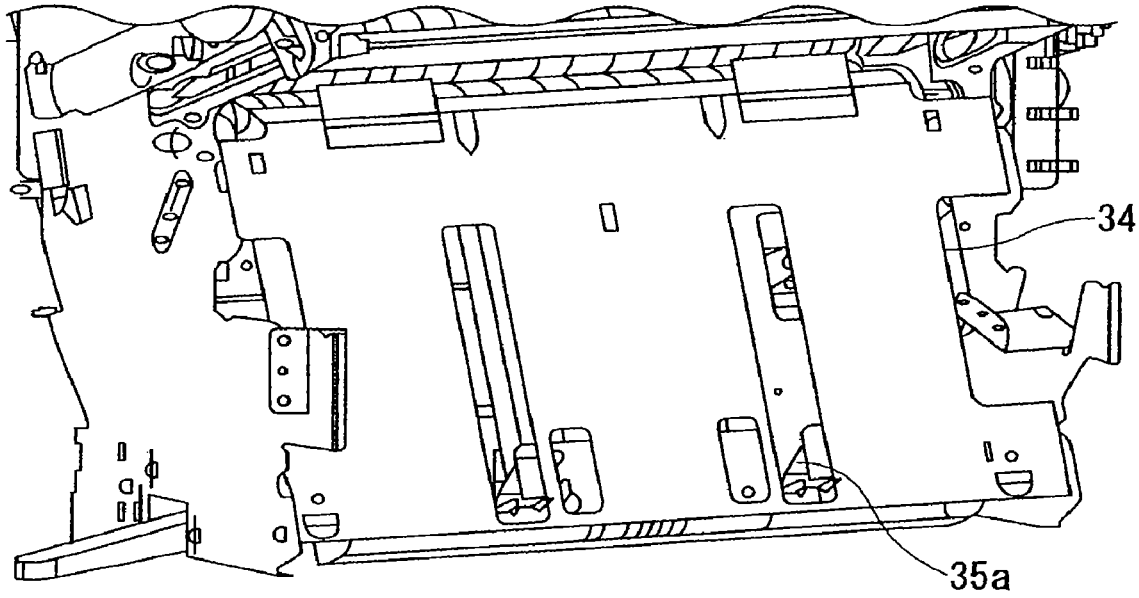
FIG. 7 is an expanded view illustrating a stacker of the saddle stitcher.

FIG. 7 is an expanded view illustrating the stacker 35 included in the saddle stitcher 30. The stacker claw 35*a* in the lower portion of the stacker 35 receives the lower end of the sheets reversed and dropped from an upper slope portion of the erect tray 34.

Figure 8:
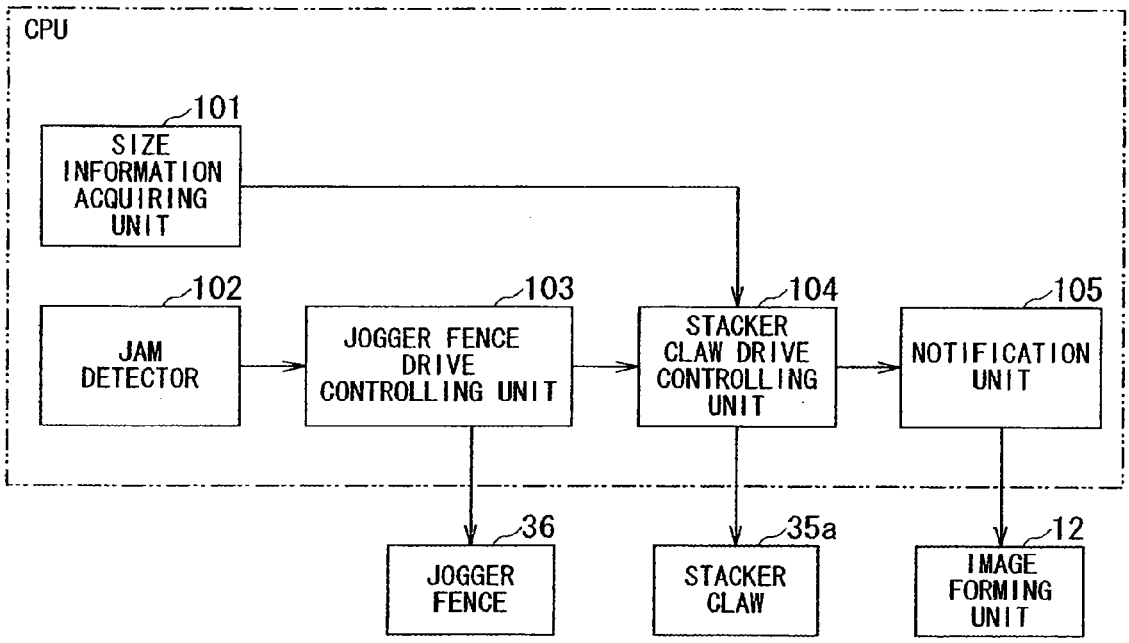
FIG. 8 is a block diagram illustrating functions of the stacker and the pair of the jogger fences.

FIG. 8 is a block diagram illustrating the functions of the stacker 35 and the jogger fence 36.

The sheet finisher 20 functions as a size information acquiring unit 101, a jam detector 102, a jogger fence drive controlling unit 103, a stacker claw drive controlling unit 104, and a notification unit 105 by execution of a program by a controller included in the sheet finisher 20. Note that the sheet finisher 20 may have each of units 101-105 as hardware.

The size information acquiring unit 101 has a function to acquire information on a size of the printed sheet, which the image forming system 12 discharges to the sheet finisher 20, from the CPU of the image forming system 12.

The jam detector 102 has function to recognize a location of jam occurrence during the saddle-stitching and cancels a job, if one of the transport sensors 146 detects jam occurrence of a sheet (sheet jam, hereinafter referred to as "jam"). For example, the detection of jam occurrence by the one of the transport sensors 146 is that the one continues detecting the sheet over threshold time. The jam detector 102 has function to cancel a job, too. The saddle-stitching stops due to the cancel. The saddle-stitching can restart, if a user removes the jammed sheet and all sheets stopped in the sheet transport passage.

The jogger fence drive controlling unit 103 has a function to drive the jogger fence 36 to be located at a home position (which is a position from which elements of the jogger fence are spaced from each other), if the jam detector 102 cancels the job.

Figure 9:
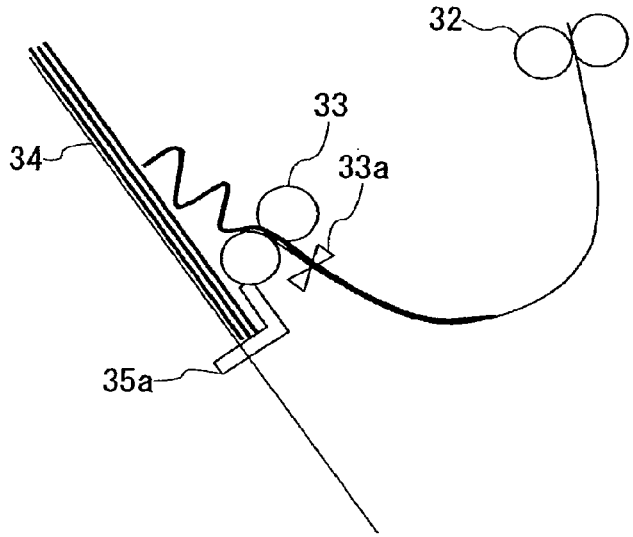
FIG. 9 is a schematic view illustrating an example of a mechanism which a pair of exit rollers causes jam occurrence.

FIG. 9 is a schematic view illustrating an example of a mechanism which the pair of exit rollers 33 causes jam occurrence.

The pair of exit rollers 33 transports the sheet that the pair of intermediate rollers 32 transports to the erect tray 34 so that the front end of each sheet faces to the upper portion of the slope of the erect tray 34. If the pair of exit rollers 33 transports each sheet to the erect tray 34, the transport sensor 33*a* of an upstream side of the pair of exit rollers 33 detects whether the jam occurs in the pair of intermediate rollers 32 in accordance with an timer interval from an ON state of detecting the sheet to an OFF state of not detecting the sheet.

The stacker claw drive controlling unit 104 has function to determine whether the stacker claw 35*a* in the lower portion of the stacker 35 can be driven, if the jam detector 102 cancels the job. The stacker claw drive controlling unit 104 has function to drive the stacker claw 35*a* in the lower portion of the stacker 35 up to an upper opening where the sheet is removed and moves the bundle of sheets to the upper opening, if the stacker claw 35*a* can drive. The stacker claw drive controlling unit 104 drives the stacker claw 35*a* to the upper opening, only if a sheet length in the sheet transport direction based on a sheet size acquired by the size information acquiring unit 101 is equal to or less than a threshold. The stacker claw drive controlling unit 104 may control a drive range of the stacker claw 35*a* so as to be variable in accordance with the sheet size which the size information acquiring unit 101 acquires.

The notification unit 105 has function to notify the jam occurrence location which the jam detector 102 recognizes to the image forming system 12. The image forming system 12 displays the notified jam occurrence location which the notification unit 105 notifies on the display panel 9*a* of the image forming system 12.

Note that it is preferable to terminate the drive of the jogger fence 36 by the transverse alignment drive controlling unit 103 and the drive of stacker claw 35*a* by the stacker claw drive controlling unit 104, before the jam which the jam detector 102 recognizes is displayed on the display panel 9*a*.

Figure 10:
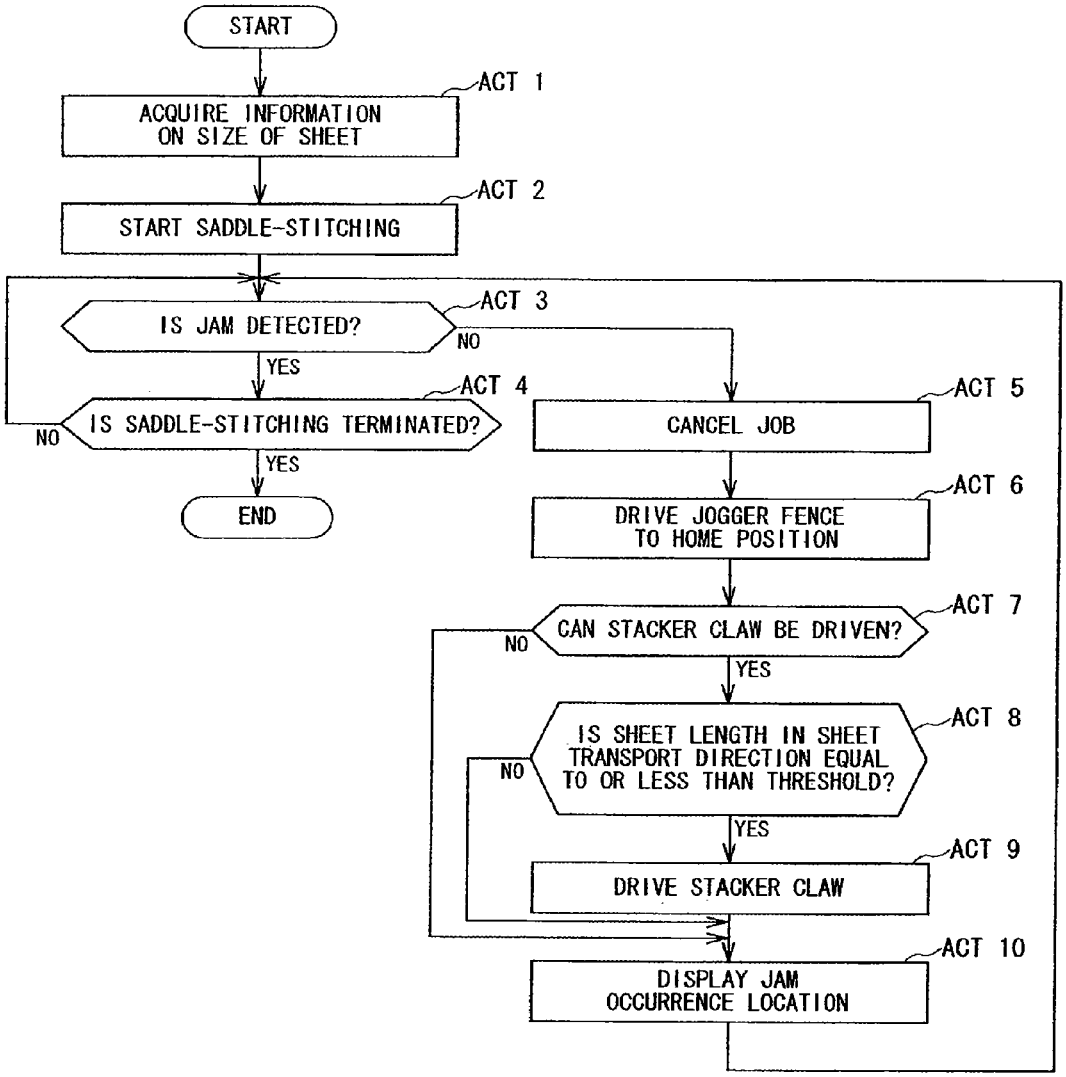
FIG. 10 is a flowchart illustrating an operation example of the stacker and the jogger fence.

FIG. 10 is a flowchart illustrating an operation example of the stacker 35 and the jogger fence 36.

First, the CPU of the sheet finisher 20 acquires the information on the size of the printed sheet, which the image forming system 12 discharges to the sheet finisher 20, from the CPU of the image forming system 12 (Act 1). Subsequently, the sheet finisher 20 starts the saddle-stitching (Act 2).

The sheet finisher 20 determines whether at least one of the transport sensors 146 detects the jam occurrence during the saddle-stitching (Act 3). If the result is Yes in Act 3, that is, if the sheet finisher 20 determines that the jam is not detected, the sheet finisher 20 determines whether to terminate the saddle-stitching (Act 4). If the result is Yes in Act 4, that is, if the sheet finisher 20 determines that the saddle-stitching is terminated, the sheet finisher 20 terminates the saddle-stitching. On the other hand, if the result is No in Act 4, that is, if the sheet finisher 20 determines that the saddle-stitching is not terminated, the intermediate the sheet finisher 20 continues saddle-stitching, and then the sheet finisher 20 determines whether at least one of the transport sensors 146 detects the jam occurrence (Act 3).

If the result is No in Act 3, that is, if the sheet finisher 20 determines that the jam occurs, the sheet finisher 20 cancels the job (Act 5). Upon canceling the job in Act 5, the sheet finisher 20 stops the saddle-stitching. Therefore, the sheet finisher 20 does not restart the saddle-stitching, if the user does not remove the jammed sheet and all the sheets stopped in the sheet transport passage.

If the sheet finisher 20 cancels the job in Act 5, the sheet finisher 20 drives the jogger fence 36 to the home position (Act 6).

Subsequently, the sheet finisher 20 determines whether the stacker claw 35*a* in the lower portion of the stacker 35 can be driven (Act 7). If the result is Yes in Act 7, that is, if the sheet finisher 20 determines that the stacker claw 35*a* in the lower portion of the stacker 35 can be driven, the sheet finisher 20 determines whether the sheet length in the sheet transport direction based on the sheet size acquired in Act 1 is equal to or less than the threshold (Act 8). If the result is Yes in Act 8, that is, if the sheet finisher 20 determines that the sheet length in the sheet transport direction is equal to or less than the threshold, the sheet finisher 20 drives the stacker claw 35*a* (Act 9).

In Act 8, the sheet finisher 20 may determine whether the sheet length in the sheet transport direction is equal to or less than a second threshold larger than the first threshold. In this case, when the sheet length in the sheet transport direction is equal to or less than the first threshold, the sheet finisher 20 drives the stacker claw 35*a* by the maximum drive amount. On the other hand, when the sheet length in the sheet transport direction is larger than the first threshold and equal to or less than the second threshold, the sheet finisher 20 drives the stacker claw 35*a* by the half of the maximum drive amount.

Subsequently, the sheet finisher 20 displays the jam occurrence location which Act 3 detects on the display panel 9*a* (Act 10) and prompts the user to remove all the sheets stopped in the sheet transport passage.

On the other hand, if the result is No in Act 7, that is, if the sheet finisher 20 determines that the stacker claw 35*a* in the lower portion of the stacker 35 cannot be driven, the sheet finisher 20 does not drive the stacker claw 35*a* and displays the jam occurrence location on the display panel 9*a* (Act 10).

In addition, when the result is No in Act 8, that is, when the sheet length in the sheet transport direction is equal to or less than the threshold, the sheet finisher 20 does not drive the stacker claw 35*a* and displays the jam occurrence location on the display panel 9*a* (Act 10).

Subsequently, if the user removes all the sheets stopped in the sheet transport passage, the sheet finisher 20 restarts the saddle-stitching, and proceeds to the operation of Act 3.

In the sheet finisher 20 functioning as the units 101 to 105 or operating in Acts 1 to 10, it is easy for the user to remove the bundle of sheets stopped in the erect tray 34, when the jam occurs in one of locations in the sheet finisher 20.

(3) Structure, Function, and Operation of Discharging Mechanism 40

Figure 11:
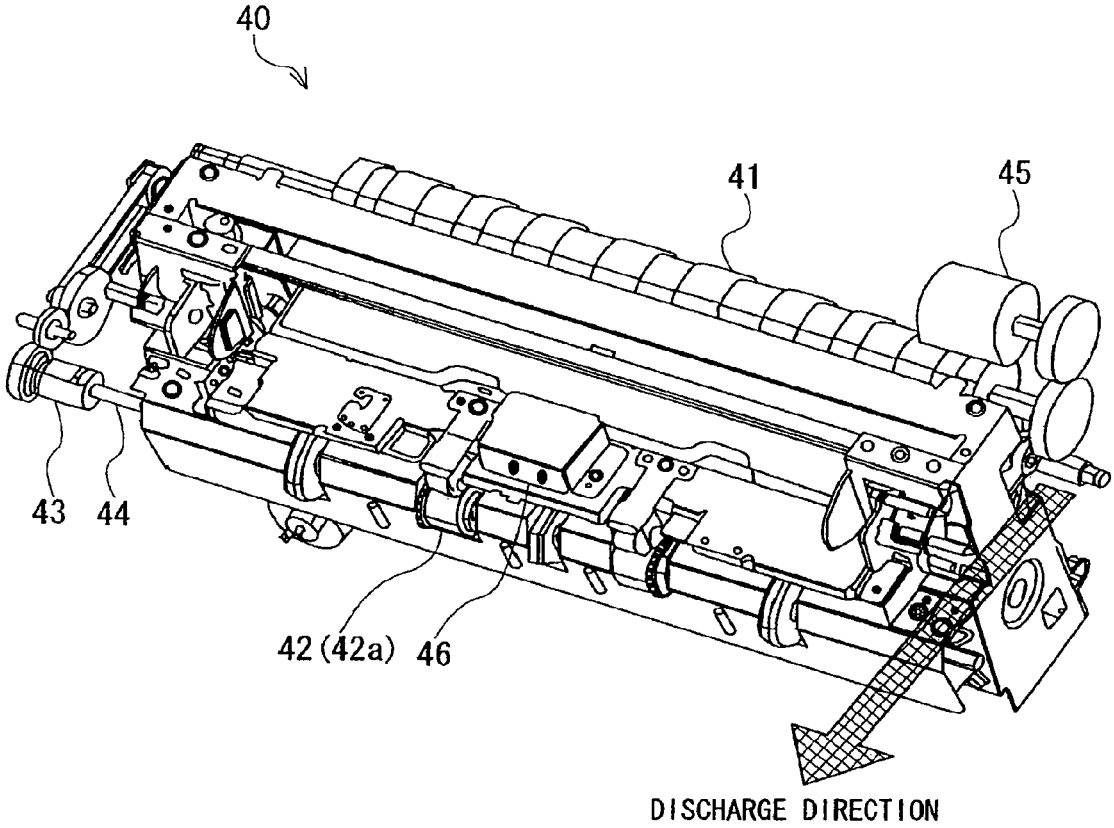
FIG. 11 is a perspective view illustrating a whole configuration example of a discharging mechanism.

FIG. 11 is a perspective view illustrating a whole configuration example of the discharging mechanism 40.

The discharging mechanism 40 includes the pair of saddle reinforcing rollers 41, the pair of transport rollers 42 (the lower transport roller 42*a*), a torque limiter 43, a shaft 44, the discharging motor 45, and the discharging sensor 46. The pair of saddle reinforcing rollers 41 moves while pressurizing the folding line in a direction perpendicular to the transport direction of the bundle of sheets to enhance the folding line.

The torque limiter 43 delivers the power of the discharging motor 45 to the shaft 44 and the lower transport roller 42*a* through the pair of saddle reinforcing rollers 41.

The discharging sensor 46 is an optical sensor which detects the book which the pair of saddle reinforcing rollers 41 transports.

The pair of saddle reinforcing rollers 41 enhances the folding line of the bundle of sheets, outputs the bundle of sheets from the pair of transport rollers 42 to the saddle tray 50. The saddle tray 50 stacks the book as the bundle of sheets.

Figure 12:
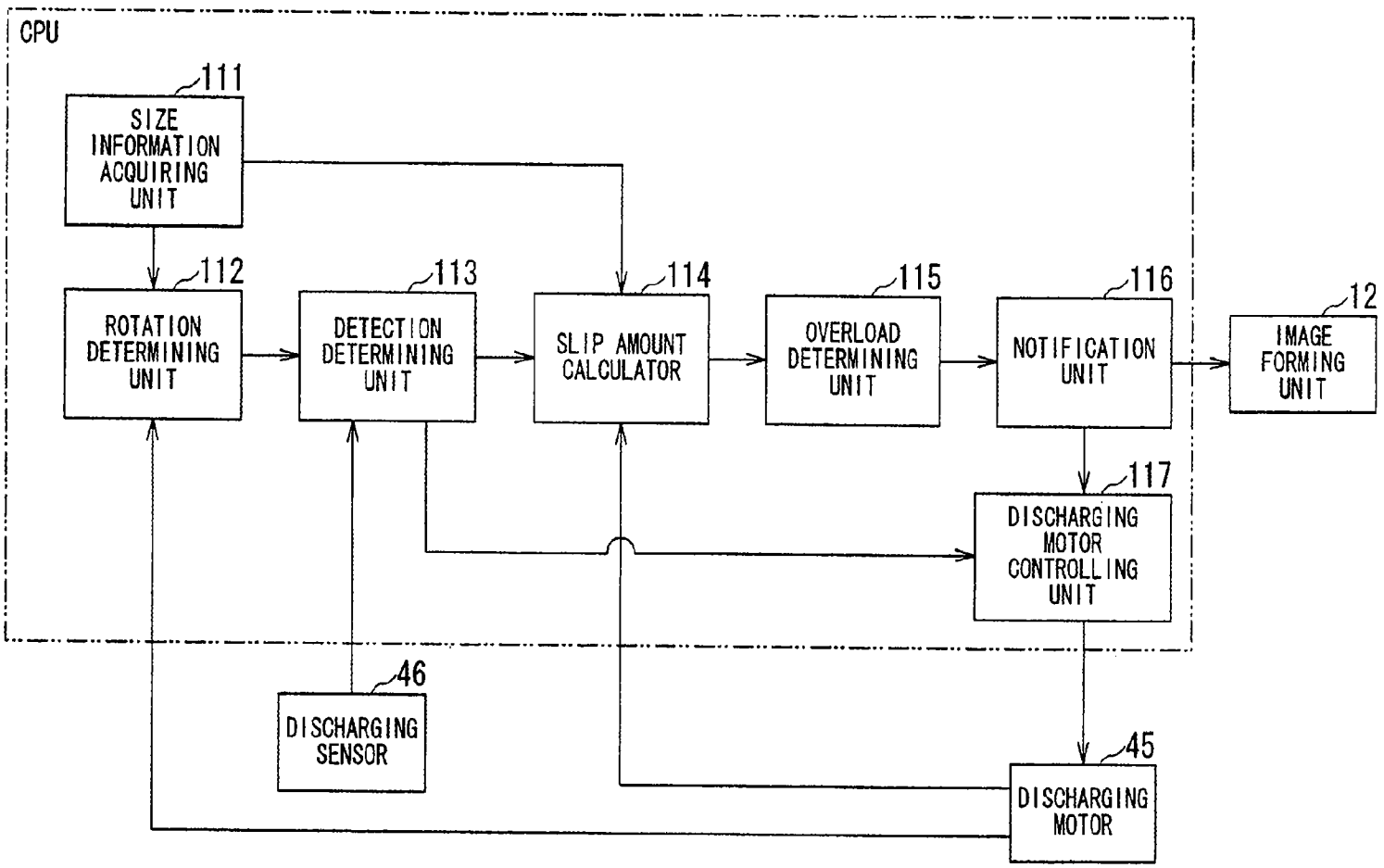
FIG. 12 is a block diagram illustrating functions of the discharging mechanism.

FIG. 12 is a block diagram illustrating functions of the discharging mechanism 40.

The sheet finisher 20 functions as a size information acquiring unit 111, a rotation determining unit 112, a detection determining unit 113, a slip amount calculator 114, an overload determining unit 115, a notification unit 116, and a discharging motor controlling unit 117 by execution of a program by a controller included in the sheet finisher 20. In addition, the sheet finisher 20 may have the units 111 to 117 as functions of a CPU as hardware.

The size information acquiring unit 111 has a function to acquire the information on the size of the printed sheet, which the image forming system 12 discharges to the sheet finisher 20, from the CPU of the image forming system 12.

The rotation determining unit 112 has a function to determine whether rotation of the discharging motor 45 with respect to one book is equal to or less than an allowed amount of rotation on the basis of the information on the size of the sheet which the size information acquiring unit 111 acquires. Note that the allowed amount of rotation is an amount of rotation of the discharging transport motor 45 corresponding to "a sheet length in the sheet transport direction based on the size of the sheet" plus "an allowance slip length".

The detection determining unit 113 has a function to determine whether the discharging sensor 46 of the upstream side of the discharging mechanism 40, if the rotation determining unit 112 determines that the amount of rotation of the discharging motor 45 is equal to or less than the allowed amount of rotation.

The slip amount calculator 114 has a function to calculate an amount of slip on the basis of a distance corresponding to the amount of the rotation of the discharging motor 45, the information on the size of the sheet which the size information acquiring unit 111 acquires, and time when the discharging sensor 46 continues detecting the book. For example, the slip amount calculator 114 calculates the amount of slip based on "the distance corresponding to a unit amount of rotation of the discharging motor 45" times "an amount of rotation of the discharging motor 45 per unit hour" times "the time when the discharging sensor 46 continues detecting the book" minus "the sheet length in the sheet transport direction based on the size of the sheet". For example, "the amount of rotation of the discharging motor 45 per unit hour" is in proportion to the number of electrical pulses which the discharging motor 45 obtains. For example, the slip amount includes a slip amount to occur to release a load of the torque limiter 43, which exceeds a threshold. For example, the slip amount includes a slip amount to occur even if the torque limiter 43 does not slip between the discharging mechanism 40 and the book.

The overload determining unit 115 has a function to determine that the discharging mechanism 40 is not in an overload state, if the amount of slip which the slip amount calculator 114 calculates is equal to or less than a third threshold. If the amount of slip is larger than the third threshold, the overload determining unit 115 has a function to determine that the discharging mechanism 40 is in the overload state due to a fullness state of the saddle tray 50, that is, due to contact of the book which the saddle tray 50 loads with the book to be transported next time. The overload determining unit 115 has a function to determine that the discharging mechanism 40 is in the overload state due to transport jam in the discharging mechanism 40, if the rotation determining unit 112 determines that the amount of rotation of the discharging motor 45 with respect to one book is larger than the allowed amount of rotation.

The notification unit 116 has a function to notify the overload state of the discharging mechanism 40 to the CPU of the image forming system 12. The image forming system 12 displays the fact that the saddle tray 50 is full or the fact that a discharge jam occurs on the display panel 9*a* of the image forming system 12.

The image forming system 12 displays the fact that the notified saddle tray 50 is full on the display panel 9*a* of the image forming system 12, and warns a user that the saddle tray 50 is full. The image forming system 12 displays the fact that the notified discharge jam occurs on the display panel 9*a* of the image forming system 12, and stops discharging the sheet to the sheet finisher 20.

The discharging motor controlling unit 117 controls the discharging motor 45 to be stopped, if the detection determining unit 113 detects the book and if the notification unit 116 notifies that the discharging from the image forming system 12 stops.

Note that the slip amount calculator 114 may calculate the amount of slip in consideration of the sheet on which the image forming system 12 already starts the printing or the sheet on which the saddle stitcher 30 already starts the saddle-stitching. In this case, the overload determining unit 115 determines that the overload does not occur in the transport of the book, even if the sheet on which the image forming system 12 already starts the printing or the sheet on which the saddle stitcher 30 already starts the saddle-stitching is transported to the saddle tray 50.

Figure 13:
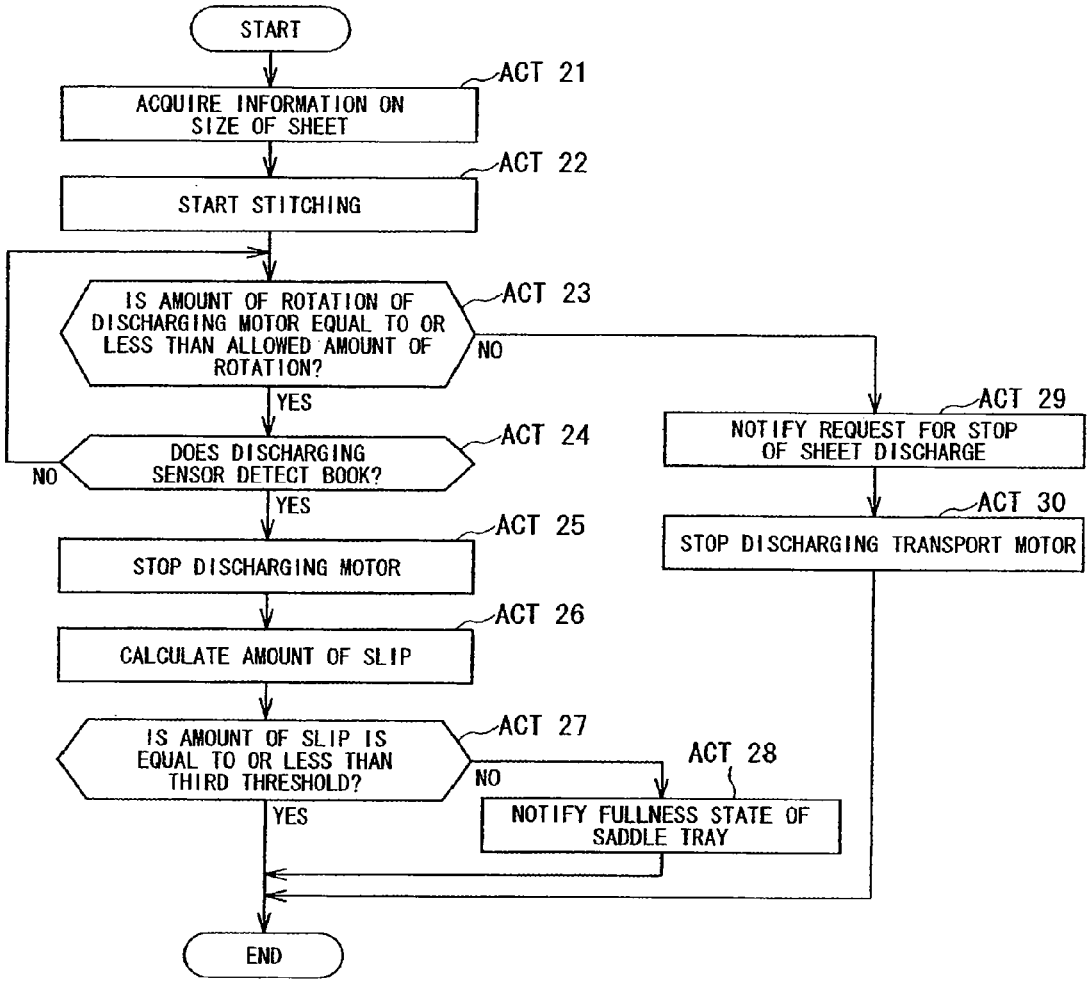
FIG. 13 is a flowchart illustrating operations of the discharging mechanism.

FIG. 13 is a flowchart illustrating the operations of the discharging mechanism 40.

First, the CPU of the sheet finisher 20 acquires the information on the size of the printed sheet, which the image forming system 12 discharges to the sheet finisher 20, from the CPU of the image forming system 12 (Act 21). Subsequently, the sheet finisher 20 starts the drive of the discharging motor 45 to stitch on the basis of the sheet which the image forming system 12 discharges (Act 22).

Subsequently, the sheet finisher 20 determines whether the rotation of the discharging motor 45 with respect to one book is equal to or less than the allowed amount of rotation (Act 23). If the result is Yes in Act 23, that is, if the sheet finisher 20 determines that the amount of rotation of the discharging motor 45 with respect to one book is equal to or less than the allowed amount of rotation, the sheet finisher 20 determines whether the discharging sensor 46 detects the book (Act 24).

If the result is Yes in Act 24, that is, if the sheet finisher 20 determines that the discharging sensor 46 detects the book, the sheet finisher 20 determines that the overload does not occur in the transport of the book, and stops the discharging motor 45 (Act 25).

Subsequently, the sheet finisher 20 calculates the amount of slip on the basis of the distance corresponding to the amount of rotation of the discharging motor 45, the information on the size of the sheet which Act 21 acquires, and time when the discharging sensor 46 continues detecting the book, if the discharging motor 45 stops (Act 26).

The sheet finisher 20 determines whether the amount of slip which Act 26 calculates is equal to or less than the third threshold (Act 27). If the result is Yes in Act 27, that is, if the sheet finisher 20 determines that the amount of slip is equal to or less than the third threshold, the sheet finisher 20 determines that the discharging mechanism 40 is not in the overload state, and terminates the discharging of the book.

Alternatively, if the result is No in Act 27, that is, if the sheet finisher 20 determines the amount of slip is larger than the third threshold, the sheet finisher 20 determines that the discharging mechanism 40 is in the overload state due to the fullness state of the saddle tray 50. In addition, the sheet finisher 20 notifies the CPU of the image forming system 12 that the saddle tray 50 is full (Act 28). Subsequently, the sheet finisher 20 terminates the transport of the book.

If the result is No in Act 23, that is, if the sheet finisher 20 determines the amount of rotation of the discharging motor 45 is larger than the allowed amount of rotation, the sheet finisher 20 determines that the discharging mechanism 40 is in the overload state due to the discharge jam occurred in the discharging mechanism 40. In addition, the sheet finisher 20 notifies that the sheet discharge from the image forming system 12 stops (Act 29). Subsequently, the sheet finisher 20 stops the discharging motor 45 (Act 30), and terminates the transport of the book.

The sheet finisher 20 functioning as the units 111 to 117 and operating in Acts 21 to 30 is capable of detecting that the saddle tray 50 is full while stacking the books at a location of a mechanical limit without mechanical discharge jam. The sheet finisher 20 is capable of detecting that the sheet cannot be actually carried out. It is not necessary to provide a separate sensor in the saddle tray 50, since detecting the fullness state of the saddle tray 50 is not necessary.

(4) Function and Operation of Various Transport Mechanisms Including Discharging Mechanism 40

Figure 14:
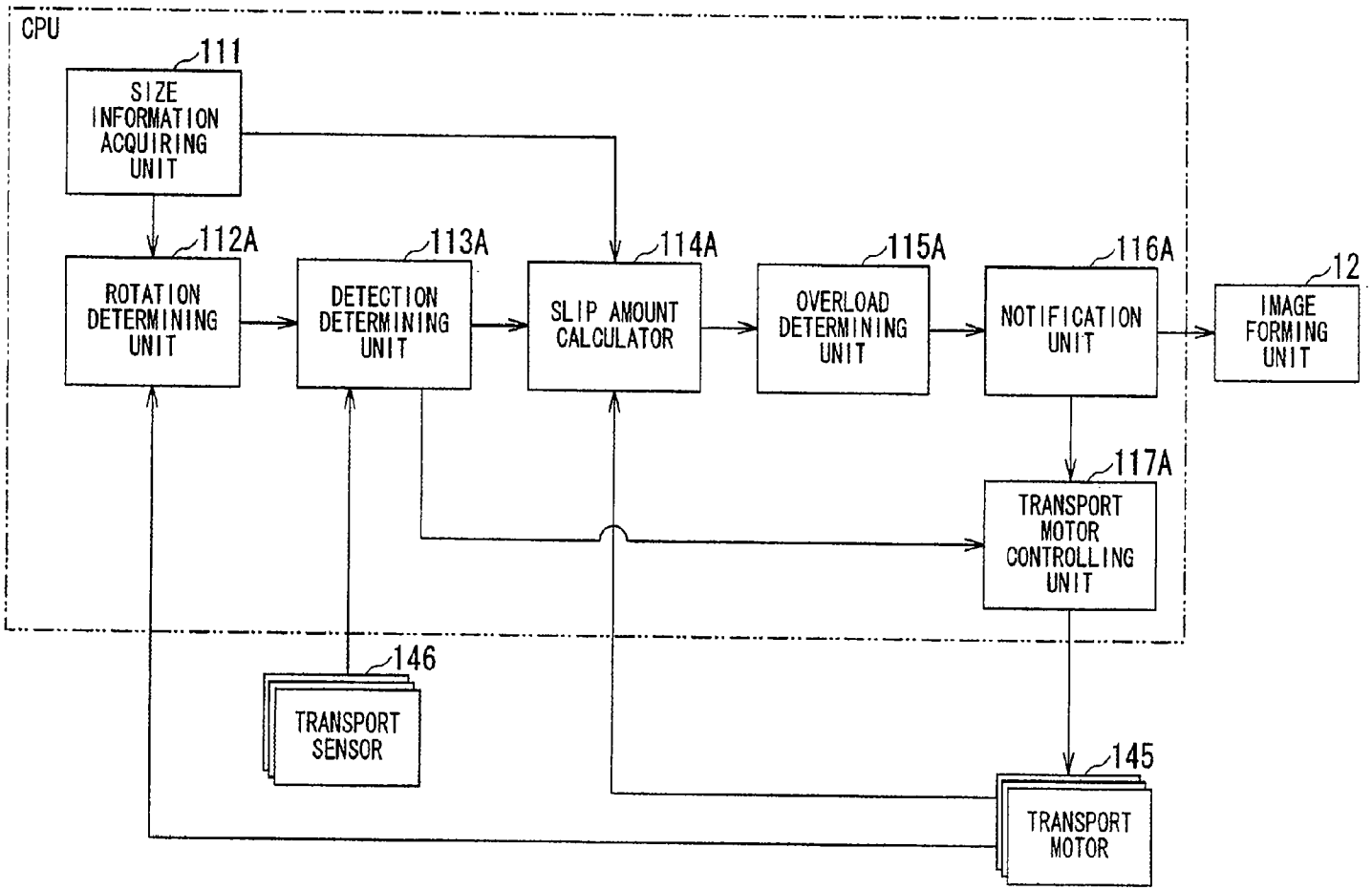
FIG. 14 is a block diagram illustrating functions of a transport mechanism.

FIG. 14 is a block diagram illustrating functions of a transport mechanism.

The sheet finisher 20 functions as the size information acquiring unit 111, a rotation detecting unit 112A, a detection determining unit 113A, a slip amount calculator 114A, an overload determining unit 115A, the notification unit 116, and a transport motor control unit 117A by execution of a program by a controller included in the sheet finisher 20. In addition, the sheet finisher 20 may have the units 111 to 117A as functions of the CPU as hardware. The same reference numerals are given to the same functions as the functions of the discharging mechanism 40 and description is omitted.

The rotation determining unit 112A has a function to determine whether the amount of rotation of each transport motors 145 with respect to one sheet (or book) is equal to or less than an allowed amount of rotation in accordance with the same determining method as that of the rotation determining unit 112.

If the amount of rotation of at least one of transport motors 145 is equal to or less than the allowed amount of rotation, the detection determining unit 113A has a function to determine whether a transport sensor, which is equal to or less than the allowed amount of rotation, of an upper stream side of the roller or the stacker detects the sheet in accordance with the same determining method as that of the detection determining unit 113.

The slip amount calculator 114A has a function to calculate the amounts of slip on the basis of the distances corresponding to the amounts of rotation of the transport motors 145, the information on the size of the sheet which the size information acquiring unit 111 acquires, and time when the transport sensors 146 continue detecting the sheet.

The overload determining unit 115A has a function to determine that each transport mechanism is not in the overload state by the same determining method as that of the overload determining unit 115, when the amount of slip is equal to or less than the third threshold.

The notification unit 116A has a function to notify the CPU of the image forming system 12 that each transport mechanism is in the overload state. The image forming system 12 displays the fact that the saddle tray 50 is full, the fact that a transport jam occurs, or a location where the jam occurs on the display panel 9*a* of the image forming system 12.

The image forming system 12 displays the fact that the notified saddle tray 50 is full on the display unit 9*a* of the image forming system 12 to warn a user. The image forming system 12 displays the fact that the notified transport jam occurs or a location where the transport jam occurs, on the display panel 9*a* of the image forming system 12, stops discharging the sheet to the sheet finisher 20.

Figure 15:
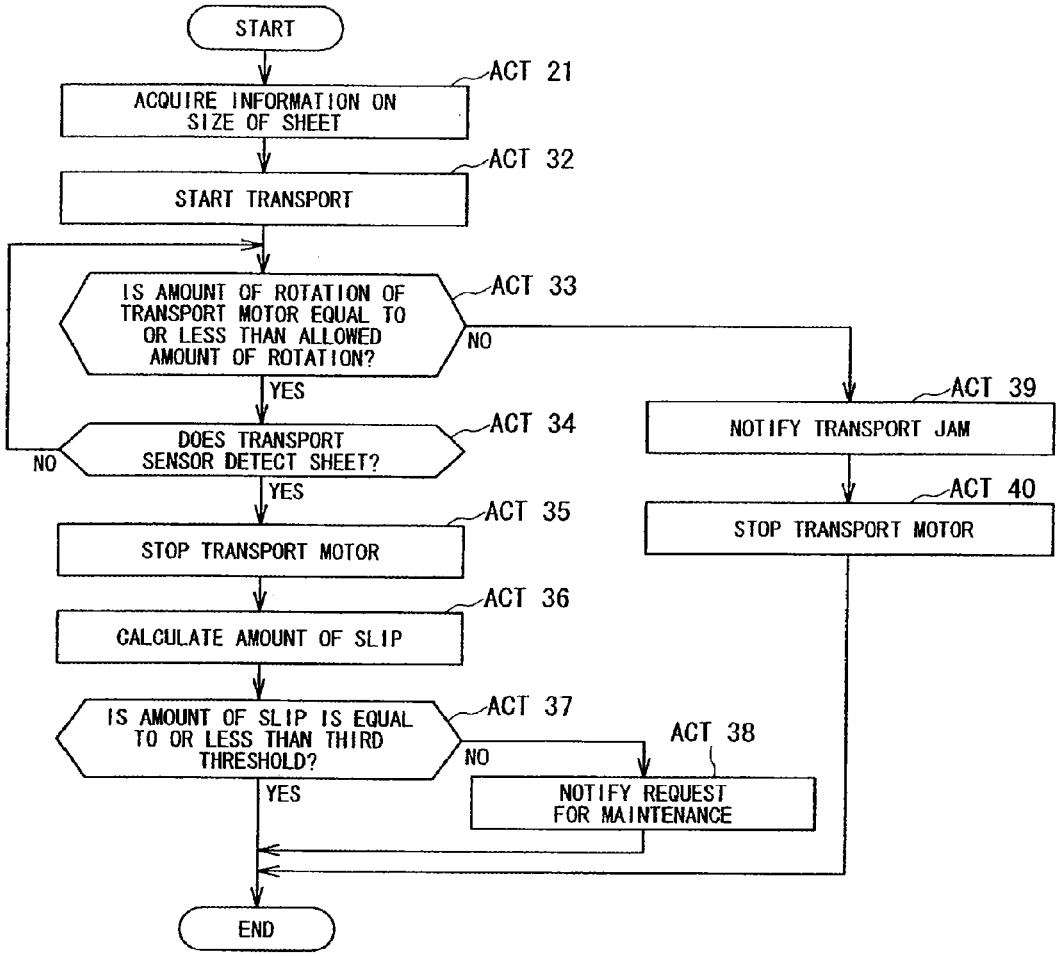
FIG. 15 is a flowchart illustrating operations of the transport mechanism.

FIG. 15 is a flowchart illustrating operations of the transport mechanism. The same act numbers are given to the same operations of the discharging mechanism 40 shown in FIG. 13 and description is omitted.

The sheet finisher 20 starts drive of the transport motors 145 to stitch as the finishing on the basis of the sheet which the image forming system 12 discharges (Act 32).

Subsequently, the sheet finisher 20 determines whether the amount of rotation of all the transport motors 145 with respect to one sheet (or book) is equal to or less than the allowed amount of rotation (Act 33). If the result is Yes in Act 33, that is, if the sheet finisher 20 determines that the amount of rotation of all the transport motors 145 with respect to one sheet is equal to or less than the allowed amount of rotation, the sheet finisher 20 determines whether the transport sensor which is equal to or less than the allowed amount of rotation, of the upstream side of the roller or the stacker detects the sheet (Act 34).

If the result is Yes in Act 34, that is, if the sheet finisher 20 determines that the transport sensor which is equal to or less than the allowed amount of rotation detects the sheet, the sheet finisher 20 determines that the overload does not occurs in the transport of the sheet, and stops the transport motors 145 (Act 35).

Subsequently, if the transport motors 145 stop, the sheet finisher 20 respectively calculates the amounts of slip on the basis of the distances corresponding to the amounts of rotation of the transport motors 145, the information on the size of the sheet which Act 21 acquires, and time when the transport sensors 146 continue detecting the sheet (Act 36).

The sheet finisher 20 determines whether all the amount of slip which Act 36 calculates is equal to or less than the third threshold (Act 37). If the result is Yes in Act 37, that is, if the sheet finisher 20 determines that all the amount of slip is equal to or less than the third threshold, the sheet finisher 20 determines that each transport mechanism is not in the overload state, and terminates the transport of the sheet.

Alternatively, when the result is No in Act 37, that is, if the sheet finisher 20 determines that at least one of amount of slip is larger than the third threshold, the sheet finisher 20 determines that maintenance of the sheet finisher 20 is necessary. In addition, the sheet finisher 20 notifies the CPU of the image forming system 12 that the maintenance of the sheet finisher 20 is necessary (Act 38). Subsequently, the sheet finisher 20 terminates the transport of the sheet.

If the result is No in Act 33, that is, if the sheet finisher 20 determines that the amount of rotation of at least one of transport motors 145 is larger than the allowed amount of rotation, the sheet finisher 20 determines that the transport jam occurs in a vicinity of the roller or the stacker in which the amount of rotation is larger than the allowed amount of rotation. In addition, the sheet finisher 20 notifies that discharging the sheet from the image forming system 12 stops (Act 39). Subsequently, the sheet finisher 20 stops the transport motor of which the rotation is larger than the allowed amount of rotation among the transport motors 145 (Act 40), and terminates the transport of the sheet.

The sheet finisher 20 functioning as the units 111 to 117A or operating in Acts 21 to 40 is capable of detecting timing at which the maintenance of the sheet finisher 20 is necessary without the mechanical transport jam while stacking the books up to a mechanical limit. The sheet finisher 20 is capable of detecting that the sheet cannot be actually carried out.

The invention is not limited to the above-described embodiment, but may be modified in various forms without departing the gist of the invention in practice steps. Various embodiments of the invention may be put into practice by appropriate combination of the plural constituent elements described above. For example, several constituent elements may be removed from the whole constituent elements of the embodiment. In addition, the constituent elements may be appropriately combined.

What is claimed is:

1. A sheet processing apparatus comprising:

a stacking unit configured to stack a sheet discharged from an image forming unit, the stacking unit including a stacker configured to support a lower end of the sheet and a supporter being configured to support an under side of the sheet;

a driver configured to drive the stacker along the supporter;

an opening configured for allowing removal of the sheet on the stacker to an outside; and a controller configured to control the stacker so that the stacker is driven to the opening along the supporter if a process is cancelled and if the sheet on the stacker needs to be removed.

2. The apparatus according to claim 1, wherein the stacker is arranged below the supporter.

3. The apparatus according to claim 2, wherein the stacker is configured to be driven upward toward the opening.

4. The apparatus according to claim 3, wherein the controller is configured to drive the stacker if information corresponding to a size of the sheet on the stacker is equal to or less than a threshold.

5. The apparatus according to claim 4, wherein the controller is configured to have a plurality of drive ranges of the stacker in accordance with information corresponding to a plurality of expected sizes of the sheet.

6. The apparatus according to claim 3, further comprising:

a sensor configured to sense a jam occurrence of the sheet on the stacker, wherein the controller is configured to determine whether the stacker is able to be driven by the driver in accordance with a state of the sensor, and to prevent the stacker from driving if the stacker is not able to be driven.

7. The apparatus according to claim 3, wherein the controller is configured to determine whether the stacker is able to be driven by the driver, and, if the stacker is able not to be driven, to prevent the stacker from driving before a cancel of a discharge process of the sheet to an outside tray is displayed.

8. A sheet processing apparatus having:

a stacking means for stacking a sheet discharged from an image forming unit, the stacking means including a bottom stacking means for supporting a lower end of the sheet and a supporting means for supporting an under side of the sheet;

a driving means for driving the bottom stacking means along the supporting means;

a removing means for allowing removal of the sheet on the bottom stacking means to an outside; and a controlling means for controlling the stacking means so that the bottom stacking means is driven to the removing means along the supporting means if a process is cancelled and if the sheet on the stacking means needs to be removed.

9. The apparatus according to claim 8, wherein the bottom stacking means is arranged below the supporting means.

10. The apparatus according to claim 9, wherein the bottom stacking means is driven upward toward the removing means.

11. The apparatus according to claim 10, wherein the controlling means drives the bottom stacking means if information corresponding to a size of the sheet on the bottom stacking means is equal to or less than a threshold.

12. The apparatus according to claim 11, wherein the controlling means has a plurality of drive ranges of the bottom stacking means in accordance with information corresponding to a plurality of expected sizes of the sheet.

13. The apparatus according to claim 10, further comprising:

a sensing means for sensing a jam occurrence of the sheet on the bottom stacking means, wherein the controlling means determines whether the bottom stacking means is able to be driven by the driving means in accordance with a state of the sensing means, and prevents the stacking means from driving if the stacking means is not able to be driven.

14. The apparatus according to claim 10, wherein the controlling means determines whether the stacking means is able to be driven by the driving means, and, if the stacking means is not able to be driven, prevents the stacking means from driving before a cancel of a discharge process of the sheet to an outside tray is displayed.

15. A control method for a sheet processing apparatus having: a stacking unit configured to stack a sheet discharged from an image forming unit, the stacking unit including a stacker being configured to support a lower end of the sheet and a supporter being configured to support an under side of the sheet; a driver configured to drive the stacker along the supporter; and an opening configured for allowing removal of the sheet on the stacker to an outside, comprising:

controlling the stacker so that the stacker is driven to the opening along the supporter if a process is cancelled and if the sheet on the stacker needs to be removed.

16. The method according to claim 15, wherein the controlling controls the stacker arranged below the supporter so that the stacker is driven upward toward the opening.

17. The method according to claim 16, wherein the controlling drives the stacker if information corresponding to a size of the sheet on the stacker is equal to or less than a threshold.

18. The method according to claim 17, wherein the controlling has a plurality of drive ranges of the stacker in accordance with the information corresponding to a plurality of expected sizes of the sheet.

19. The method according to claim 16, further comprising:

sensing a jam occurrence of the sheet on the stacker, wherein the controlling determines whether the stacker is able to be driven by the driver in accordance with a state of the sensing, and prevents the stacker from driving if the stacker is not able to be driven.

20. The method according to claim 16, wherein the controlling determines whether the stacker is able to be driven by the driver, and, if the stacker is not able to be driven, prevents the stacker from driving before a cancel of a discharge process of the sheet to an outside tray is displayed.

* * * * *